United States Patent [19]

Labrum

[11] 4,334,578

[45] Jun. 15, 1982

[54] WELL CASING CLOSURE

[76] Inventor: Warren W. Labrum, P.O. Box 543, Dayton, Nev. 89403

[21] Appl. No.: 149,017

[22] Filed: May 12, 1980

[51] Int. Cl.[3] ..... B65D 55/14; E21B 33/02

[52] U.S. Cl. ..... 166/75 R; 70/164; 292/300

[58] Field of Search ..... 166/95, 97, 85, 83, 166/75 R; 292/300–302; 404/25; 49/463, 465; 70/164

[56] References Cited

U.S. PATENT DOCUMENTS

| | | | |
|---|---|---|---|
| 1,106,295 | 8/1914 | Gail | 166/95 X |
| 1,578,194 | 3/1926 | Edelman | 292/300 X |
| 1,791,277 | 2/1931 | Lake | 70/164 |
| 1,835,418 | 12/1931 | McHardy | 166/95 X |
| 2,562,946 | 8/1951 | Read | 166/75 |
| 2,566,870 | 9/1951 | Beagle | 292/301 |
| 3,095,929 | 7/1963 | McGuire et al. | 166/97 |
| 3,122,012 | 2/1964 | Christopher | 292/251 X |
| 3,631,895 | 1/1972 | Medina et al. | 166/97 X |
| 3,756,314 | 9/1973 | Valley | 166/95 |
| 3,782,146 | 1/1974 | Franke | 166/85 X |

*Primary Examiner*—Stephen J. Novosad
*Attorney, Agent, or Firm*—Herbert C. Schulze

[57] ABSTRACT

This invention is a well casing closure for closing and covering the top of a well casing extending above the surface of the ground. The invention is characterized by comprising a hollow cylindrical member closed on one end and open on the other end of such dimension as to fit over the top of the well casing and to provide a reasonably snug fit about the exterior of the casing; it is further characterized by utilizing an "O" ring or the like, for sealing between the interior of the closure and the exterior of the casing; additionally, a locking mechanism is incorporated so that the closure may be locked in place over the opening and only removed by one having a key to the lock.

10 Claims, 12 Drawing Figures

FIG. 1.
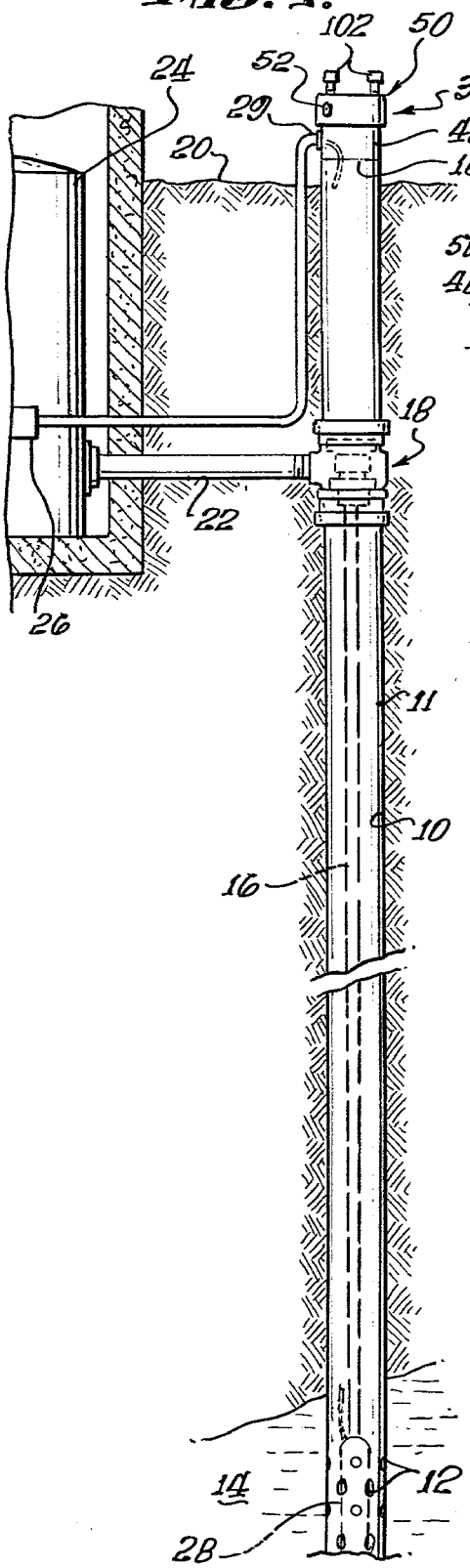
PRIOR ART
FIG. 3.
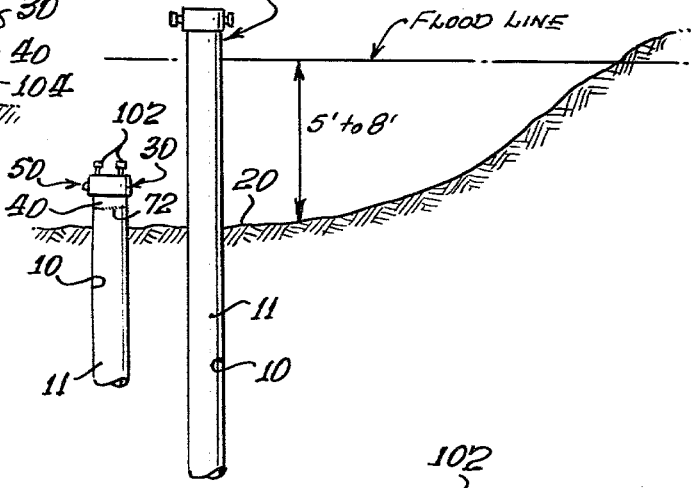
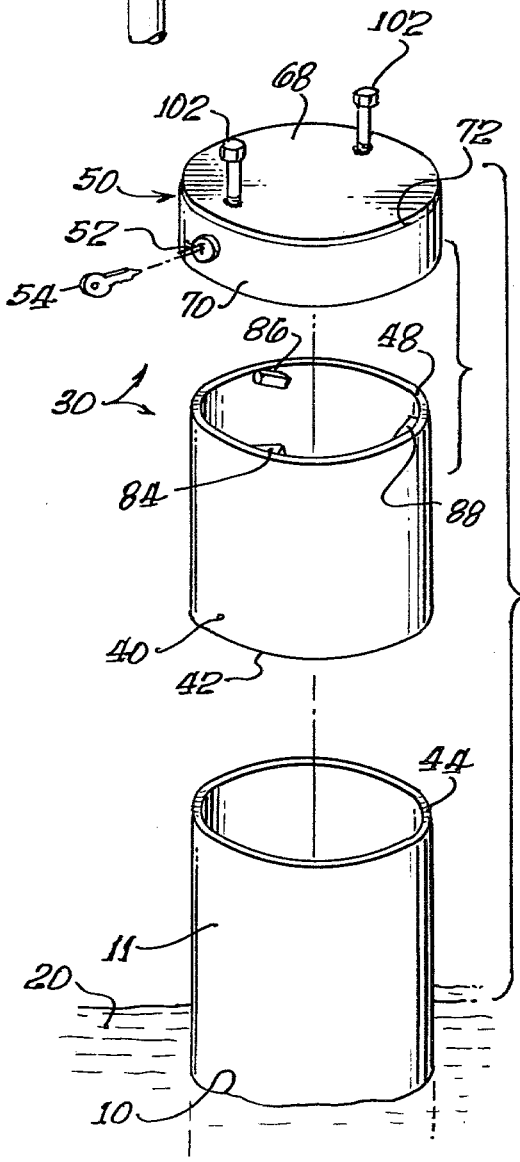
FIG. 2.

WELL CASING CLOSURE

CROSS REFERENCE TO RELATED PATENT APPLICATIONS

There are no patent applications filed by me related to the within application.

BACKGROUND OF THE INVENTION

1. Field of the Invention

This invention is in the general field of well casing closures, and is more particularly in the field of such closures having locking means and sealing means to prevent fluids from escaping the well and to prevent undesirable material from entering the well and also to prevent vandalism.

2. Description of the Prior Art

The closure of well casings extending above the surface of the ground is required by many governmental agencies and regulations. Up until the present invention, such closures were either by loosely fitting caps, by welded closures over the top of the casing; or by bolted caps and flanged and the like. There is no prior art known by me incorporating an easily removable locking cap or closure for the top of a well casing which also hermetically seals the interior of the well casing from contact with the exterior environment.

SUMMARY OF THE INVENTION

Well casings, which have been installed into drilled holes, normally consist of a portion of the casing projecting above the surface of the ground. This extending portion is then capped, or closed, by conventional means which include welding or bolting the closure over the open upper end.

Customarily, the closure is intended to prevent undesirable matter from falling into or being deposited into the well. Such undesirable material could harm equipment which has been installed in the well, such as a pump, valve, or pitless connection. Other problems, such as animals or children, have been known to enter the well causing serious injury or loss of life.

It has been difficult in the past to provide a satisfactory closure for wells, particularly water wells, which closure at the same time provides easy access for proper persons but difficult access for other purposes and in addition, provides a seal against the surrounding environment. Up until the present invention there have been loose fitting caps placed over wells, either loosely, slightly welded, bolted, or the like, as one means. Another means has been to totally weld closed the well opening.

The previous caps either failed to provide an adequate, and especially a sealed closure which could not be readily removed, or provided a totally closed casing (by welding or the like) which was very difficult for access for proper purposes.

I have been actively engaged in the study of the problem of well closures (while the present invention applies to any type well casing, it is primarily for water wells). After much experimentation and development work, I have now conceived and developed a closure which can readily be installed by most persons working upon wells and which provides a positive, tamper proof closure which seals the interior of the casing from the exterior and also which can be removed readily by one having the key to a lock provided thereon.

I have accomplished the desired end by providing a cylindrical cap closed at one end, having handle means on its top exterior, and having lugs which interconnect with lugs welded to the interior of the casing. A lock is provided in connection with one of the lugs so that when in place the lock prevents it from removal from its patching lug, thus preventing removal from the casing. Additionally I have provided sealing means in the form of an "O" ring or the like, between the interior of the cylindrical portion of the cap and the exterior of the casing, which sealing means prevents intercommunication between the interior of the well casing and the exterior environment.

It is an object of this invention to provide an apparatus to close the top of the well casing projecting above the surface of the ground for prevention of any undesirable material from getting into the well.

Another object of this invention is to provide such a closure as heretofore mentioned wherein a locking means can be provided to prevent unwarranted removal of the closure from the casing.

Another object of this invention is to provide such a closure as heretofore described, which, once secured, will seal the opening of a well casing from the exterior.

Another object is to provide such an apparatus as heretofore mentioned wherein rotation of the closure for locking and sealing is capable of being altered so as to confuse anyone tampering with the closure.

The foregoing and other objects and advantages of this invention will be apparent to those skilled in the art and upon reading the description of a preferred embodiment, which follows, in conjunction with a review of the appended drawings.

BRIEF DESCRIPTION OF THE DRAWINGS

FIG. 1 is a partly broken away, partly sectioned, elevation of a well casing in place and utilizing a preferred embodiment of this invention;

FIG. 2 is an enlarged, exploded perspective view illustrating the components of the preferred embodiment shown in FIG. 1;

FIG. 3 is a schematic elevational view partly in section showing the installation of a preferred embodiment of this invention as compared to prior devices;

DESCRIPTION OF A PREFERRED EMBODIMENT

Figure 4:
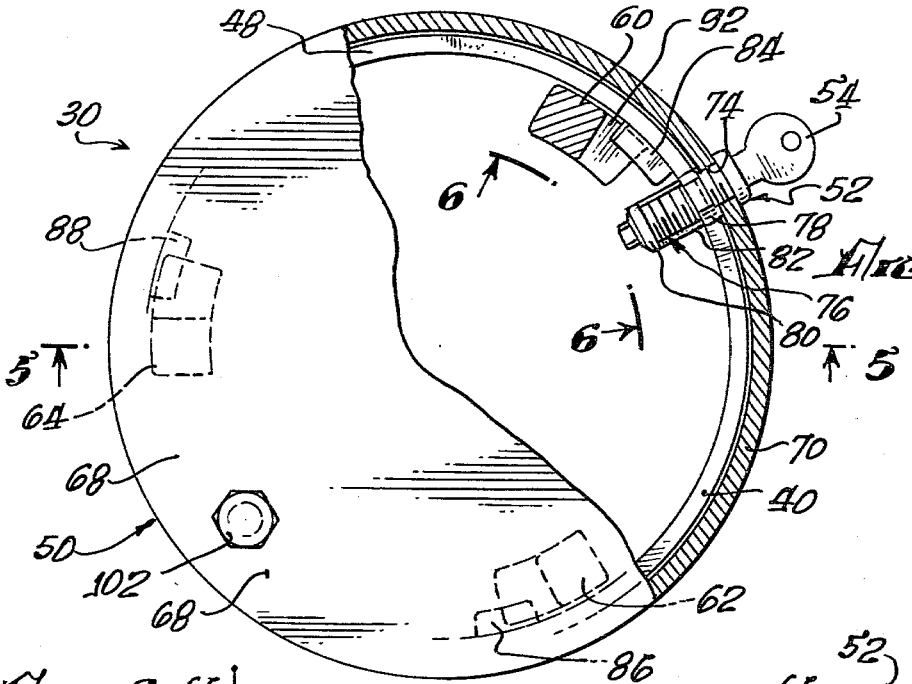
FIG. 4 is an enlarged top plan view partly broken away of the closure shown in FIGS. 1 and 2.

FIG. 1 illustrates a conventional drilled well hole 10, into which a casing 11 has been inserted. Casing 11 has openings 12 at its lower end in order to allow the liquid 14, which is to be pumped to the surface, into the casing drop pipe 16, past a pitless connection area 18 and then to the surface 20 of the ground.

To those familiar in the art, the liquid being pumped is then pumped through a discharge pipe 22 into a reservoir 24 where it is stored for use and distribution by an electrical control unit 26 which controls the action of the pump 28 and its flow of liquid. The electrical connection is normally brought into the soil below the surface and then into the casing at 28, thereby completing the conventional hookup for such a system.

The closure assembly 30, which is the subject of my invention, is placed onto the casing above the ground level after the well has been drilled and the casing inserted. The pitless connection can be put on prior to the completion of the upper portion of the well or the earth can be removed down to the level of the connection and then by cutting torch and weldment the connection can be inserted at that time.

In the perspective of FIG. 2 it can be seen that the closure assembly is composed of a segment of casing pipe 40 which is welded at its lower portion 42 to the top 44 of the casing segment 46 which is located above the pitless connection 18 and above the surface 20 of the ground. A cap 50 is then placed over the top edge 48 of the casing segment 40 after the segment has been welded to the casing 46. Rotation of the cap 50 then locks it into position so as to be retained by the lock mechanism 52 with its key 54.

FIGS. 4 through 7 show in greater detail the components of the closure assembly. The cap 50 has a plurality of downwardly extending locking members 60, 62, and 64 which are welded to the flat top member of the cover 68 at points 66. A cylindrical downwardly extending sleeve portion 70 of the cap is welded at 72 to the top plate 68 and has an opening 74 into which a tumbler type lock assembly 76 is inserted. This lock assembly is retained in the opening 74 by a nut 78. At the end of the lock mechanism 76 closest to the axial center line of the casing is located an "L" shaped locking bar 80 having a leg 82 which can be moved into a locking position hereinafter described.

Figure 7:
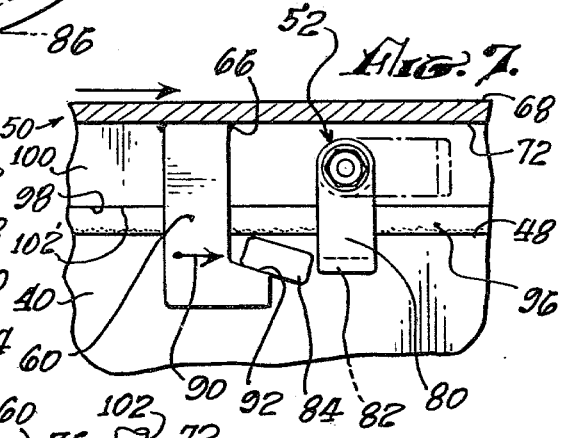

In FIG. 7, welded or otherwise mounted to the inside diameter of the casing segment 40 are a plurality of angularly disposed lock lugs 84, 86, and 88 which cooperate with the downwardly projecting lugs 60, 62, and 64, in order to lock the cap 50 onto the casing segment 40.

Figure 6:
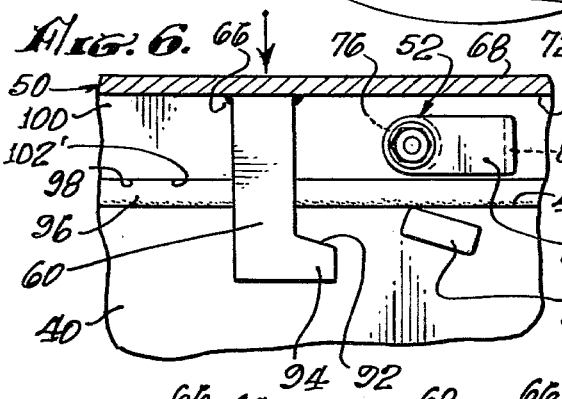
FIGS. 6 and 7 are views taken in the direction of the arrows along line 6—6 of FIG. 4 showing the position of the cap on the casing segment in its unlocked and locked positions.

When the cap is placed upon the casing 40, as shown in FIG. 6, the lugs 60 through 64 are not in contact with the lugs 84 through 88, but when the cap is rotated into the direction of the arrow 90, as shown in FIG. 7, then the lug 84 comes into contact with a tapered face 92 of an extension 94 of the lug 60. Then, the locking bar 80 is rotated into the position of FIG. 7, and when the key 96 is removed from the lock the cap is retained in a locked condition and unable to be rotated out of contact with the lugs 84.

A sealing means such as on "O" ring 96 may be placed into the closure assembly by retaining it within a groove 98 in the skirt 70. A spacer ring 100 which is fastened by welding into the inside of the cap as shown, provides a sealing surface 102 for the "O" ring 96 so that when the cap has been rotated and locked into the position shown in FIG. 7, it also has provided a seal against liquids coming out of the well casing or into the well casing at this point of contact.

Figure 5:
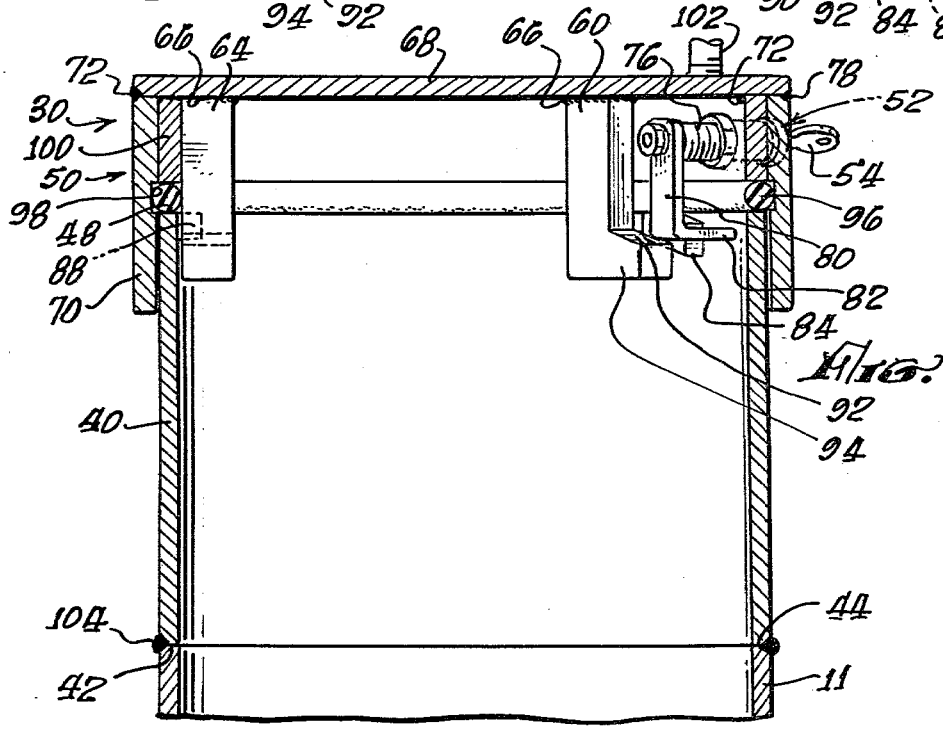
FIG. 5 is a sectional view taken on line 5—5 of FIG. 4.
Figure 8:
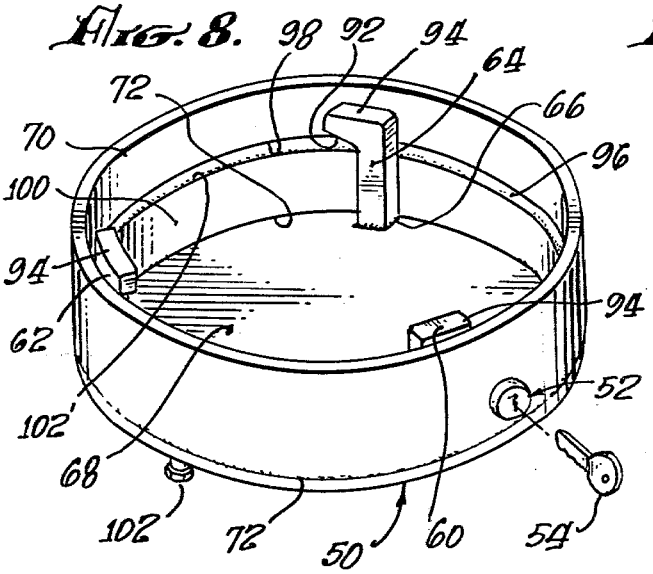
FIG. 8 is a perspective view looking at the underside of the cap portion of the closure assembly.

I have provided a pair of bolts 102 that are welded to the topmost surface of the cap 50. These provide a better grip for an individual who is rotating the cap into a locked or unlocked position. In FIG. 5, I have also shown the weld 104 which connects the closure assembly to the actual well casing. This weldment can be removed should a different type of equipment be necessary to add onto the top of the portion of the well casing projecting above the ground surface 20.

Figure 9:
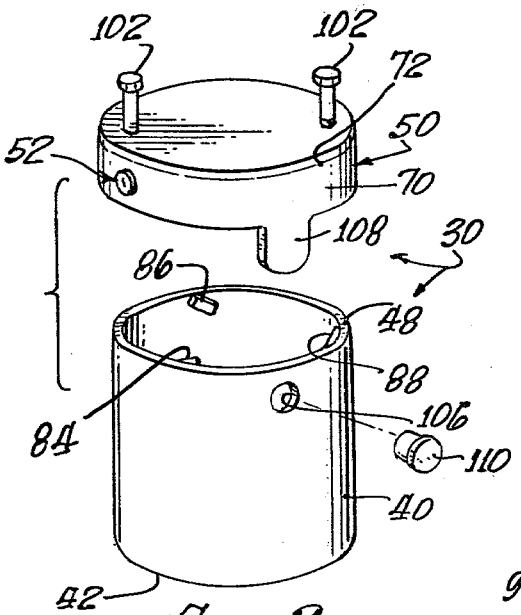
FIG. 9 is an exploded perspective of a modified form of closure assembly.

In the modification of FIG. 9, when it is desired, to have the opening 106 initially placed into the casing segment 40 at the point of manufacture, I have provided a protective ear 108 onto the lower portion of the cap skirt 70, which will come into alignment with the opening 106 when the cap has been rotated into a locked position so as to keep undesirable material from entering the casing prior to the completion of the electrical connection. An appropriate type of seal 110, such as a rubber plug, can be placed into the opening to seal the closure assembly as previously described. This plug can be removed when a connection is to be installed.

Figure 10:
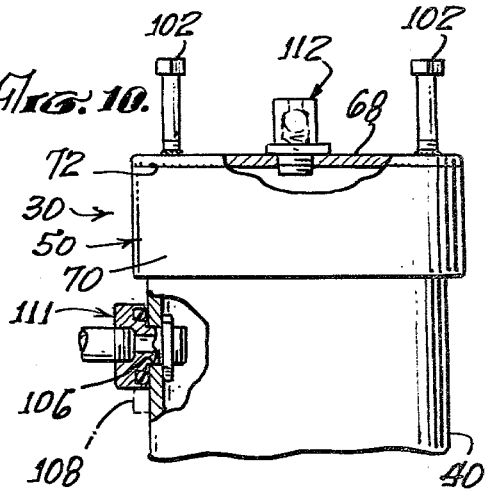
FIG. 10 is a a fragmentary side elevational view with parts broken away showing still a further modification of my invention.

In FIG. 10, I have shown a type of connection that can be placed into this opening to permit wiring to be installed for the pump. In this case, the ear 108 shown in phantom lines can be sawed or cut off with a welding torch and allowing the opening 106 to be exposed for this connecting unit 111. A pressure relief valve 112 may also be added to the system so as to permit a vacuum within the casing to be broken should the pump be unable to perform due to water being trapped at the upper end of the casing during pumping procedures.

Figure 11:
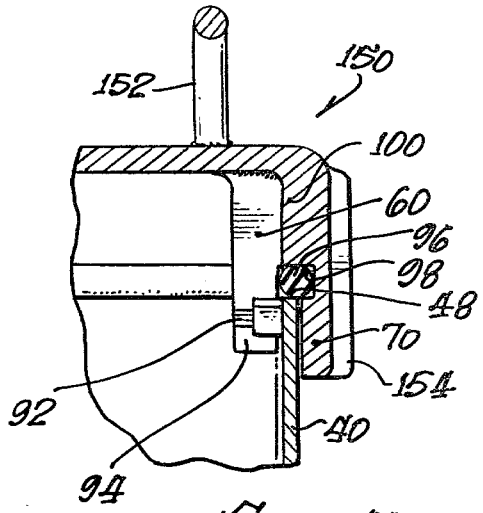
FIG. 11 is an enlarged fragmentary sectional view of yet another modified form of my closure assembly.

In FIG. 11, I have shown a more elaborate cap of the closure assembly, as indicated by the reference number 150. This cap can be formed through conventional molding and casting processes. In this modification a handle 152 can be added, of a loop configuration, and ribs 154 can be added around the cap to facilitate handling by the operator for locking or unlocking.

Figure 12:
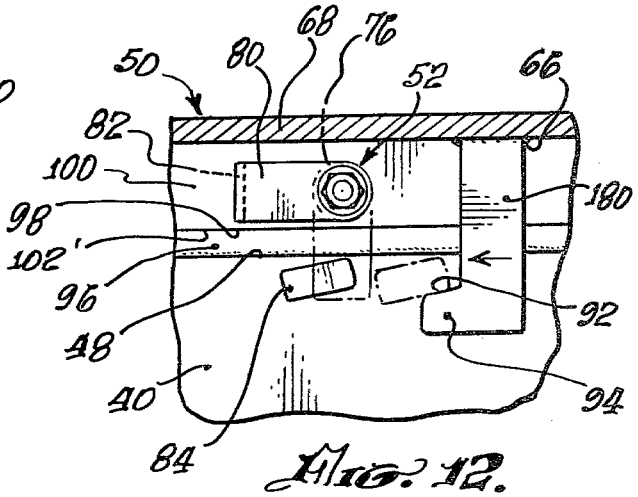
FIG. 12 is a view similar to FIGS. 6 and 7 indicating a counterclockwise method of locking the cap to the casing.

In FIG. 12, I have shown the lug 180, rotated 180 degrees from the showing of FIGS. 6 and 7, in order to permit an operator to rotate the cap into a left-handed or counterclockwise direction in order to lock it against lug 84. This is to confuse vandals and children into thinking they cannot open the cap as they rotate it in a conventional direction.

It is to be understood that numerous variations will be possible by those skilled in the art when once understanding the fundamentals of this invention, and while the embodiments as shown are fully capable of achieving the objects and advantages desired, it is to be understood that such embodiments have been for purposes of illustration and not for purposes of limitation.

I claim:

1. A well casing closure to close the open end of a well casing which comprises: an elongated cylidrical member of a larger interior diameter than the exterior diameter of a well casing and having a cover plate means closing one end of said cylindrical member; means associated with said well casing to receive means associated with said elongated cylindrical member to hold said elongated cylindrical member in place upon said well casing, and securing means to retain said elongated cylindrical member in place upon said well casing in such a manner so as not to perforate said well casing.

2. The apparatus of claim 1 wherein means are provided to prevent rotation of the cylindrical member relative to the well casing.

3. A well casing closure as set forth in claim 2 wherein said means associated with said elongated cylindrical member to hold said elongated cylindrical member in place comprises at least one downwardly projecting primary lug means, said primary lug means having an offset portion at its lower end thereof, and said lug means being affixed to the inside diameter of said well casing, said offset portion having an angularly disposed first surface on said offset portion; a secondary lug means affixed to said cover plate means, said secondary lug means having an augularly disposed surface at its underside which comes into contact with said angularly disposed surface on said primary lug means when said primary lug means is moved into contact with said secondary lug means.

4. A well casing closure as set forth in claim 3 wherein said securing means is placed in the cylindrical sidewall of said cover plate means and said securing means having a rotatably cooperative locking lug means which is rotated into a position so as to detain said well casing closure means in a position wherein said downwardly projecting primary lug means is kept from withdrawing from said secondary lug means.

5. A well casing closure as described in claim 4 wherein said sealing means is a resilient ring retained within a groove on the inside diameter surface of said elongated cylindrical member and said elongated cylindrical member having an offset shoulder means which bears against said resilient ring and compresses it against said upper normally presented end of said casing when said elongated cylindrical member has been rotated to a position when said angularly disposed surfaces of said primary and secondary lugs are brought into contact with one another.

6. A well casing closure as set forth in claim 5 wherein said primary and secondary lugs are placed in cooperation with one another so as to allow either clockwise or counterclockwise rotation of said well casing closure means with said well casing to effect contact between said primary and secondary lug means.

7. A well casing closure as set forth in claim 9 wherein the elongated cylindrical member is provided with handle means in order to effect better gripping during rotation.

8. A well casing closure as set forth in claim 7 wherein a downwardly projecting ear is provided onto the lower edge of the elongated cylindrical member in order to cover an opening which has been provided in the upper end of the casing segment.

9. A well casing closure as set forth in claim 8 wherein a pressure relief valve is provided on the upper flat surface of said elongated cylindrical member.

10. The apparatus of claim 9 wherein a sealing means is provided between said elongated cylindrical member and said well casing in which said cover plate means cooperates with said sealing means to form a seal between said cover plate means and said terminating edge of said well casing at its open end, and which edge is normal to the axis of said well casing.

* * * * *